US005794747A

United States Patent [19]

Bryant

[11] Patent Number: 5,794,747

[45] Date of Patent: Aug. 18, 1998

[54] BAGGAGE SKID PAD WITH ACTUATABLE DRAIN

[75] Inventor: Frank D. Bryant, Knoxville, Tenn.

[73] Assignee: Akona Adventure Gear, Knoxville, Tenn.

[21] Appl. No.: 572,421

[22] Filed: Dec. 14, 1995

[51] Int. Cl.[6] ..... A45C 3/10; A45C 5/02; A45C 13/00

[52] U.S. Cl. ..... 190/18 R; 206/315.1; 220/572; 220/913; 383/103; 383/117

[58] Field of Search ..... 190/18 R, 18 A, 190/109; 150/106, 112; 383/67, 100, 103, 117; 220/913, 572; 206/315.1

[56] References Cited

U.S. PATENT DOCUMENTS

| | | | |
|---|---|---|---|
| 1,251,404 | 12/1917 | Mills | 383/103 X |
| 1,418,717 | 6/1922 | Josephson | 383/100 |
| 1,938,519 | 12/1933 | Deffenbaugh | 190/109 X |
| 2,375,101 | 5/1945 | Gibbs . | |
| 2,377,311 | 6/1945 | Campbell . | |
| 2,415,956 | 2/1947 | Mamaux . | |
| 3,425,472 | 2/1969 | Marino | 383/121.1 X |
| 3,796,245 | 3/1974 | Wildensteiner | 383/67 X |
| 4,016,616 | 4/1977 | Walters | 114/16 A |
| 4,175,604 | 11/1979 | Bonner | 383/121 |
| 4,315,561 | 2/1982 | Partridge | 184/106 |
| 4,392,552 | 7/1983 | Partridge | 184/106 |
| 4,949,842 | 8/1990 | Mokiao, II | 383/103 X |
| 4,991,979 | 2/1991 | Strand et al. | 383/67 |
| 5,012,964 | 5/1991 | Falletta et al. | 383/103 X |
| 5,288,150 | 2/1994 | Bearman | 383/117 X |
| 5,433,230 | 7/1995 | Miller | 206/315.1 X |

FOREIGN PATENT DOCUMENTS

| | | | |
|---|---|---|---|
| 3145259 | 5/1983 | Germany | 383/103 |

*Primary Examiner*—Sue A. Weaver
*Attorney, Agent, or Firm*—Leatherwood Walker Todd & Mann, P.C.

[57] ABSTRACT

A skid pad has an actuatable drain for use with baggage carrying wet gear. A mesh compartment is provided in the bottom interior of the bag. Slidingly carried in the compartment is a valve member. The mesh compartment is in fluid communication with an opening provided in the bottom of the baggage. A skid pad having a plurality of holes thereon, is provided on the bottom of the bag for covering the opening in the bottom of the bag. When the valve member is removed, fluid may freely drain through the mesh compartment, the opening in the bottom of the bag, and ultimately through the holes provided in the skid pad. Because the holes in the skid pad are in recessed portions, and because of the configuration of the mesh compartment, fluid is allowed to drain from the baggage, but dirt and foreign debris is substantially prohibited from entering into the baggage through the drainage openings.

9 Claims, 3 Drawing Sheets

A
C
D
10
4
B
14
12
4

E
F

BAGGAGE SKID PAD WITH ACTUATABLE DRAIN

BACKGROUND OF THE INVENTION

This invention relates generally to a skid pad for baggage, luggage, and the like having an actuatable valve member for allowing selective drainage.

Water sports equipment, such as scuba gear, bathing suits, life vests, etc. may be stored and transported in baggage of various configurations. Soft-sided luggage or baggage is popular for this purpose, and is available in various sizes and shapes. Typically, in order to increase the life of such soft-sided baggage, durable wear, or skid, pads are provided on such baggage at high wear points, such as bottom surfaces, corners, and edge portions.

A problem arises, however, that since the water sports equipment carried by such baggage is typically wet after use, and since there may not be enough time to allow the equipment to dry before again being transported, the equipment is packed in the baggage while still wet.

Sometimes, it is preferable to allow the water from the equipment to seep or drain through the baggage, especially during short-term transport or storage. However, at other times, it would be desirable to retard seepage or drainage of the water from the equipment through the baggage, such as when wet equipment is being transported in baggage carried in the trunk of an automobile.

While baggage may be available that allows for water drainage through grommets or mesh panels, these present problems in that they may require additional assembly steps in addition to attachment of wear resistent skid pads, and in that drainage through conventional grommets and mesh allows sand and other foreign material to enter the luggage through such openings. Patented devices have not solved this problem.

For example, U.S. Pat. No. 2,415,956, issued to Mamaux, discloses an ice bag having a metal bottom with a channel therein for collecting water. U.S. Pat. No. 2,375,101, issued to Gibbs, discloses a container having metal or plastic bottom members. U.S. Pat. No. 4,175,604, issued to Bonner, discloses a mail bag having a reinforced bottom portion.

While the foregoing designs are known, there still exists a need for baggage having wear resistant means for allowing selective drainage of water and fluids, while at the same time, reducing entry of sand, dirt, and foreign matter into the baggage.

SUMMARY OF THE INVENTION

It is, therefore, the principal object of the present invention to provide a wear resistent pad for use with baggage having selectively actuatable drain means for both allowing fluid drainage from the baggage and for preventing foreign debris from entering the baggage through such drainage portions.

It is another object of the present invention to provide a baggage skid pad with a removable valve member.

It is another object of the present invention to provide a baggage skid pad having an actuatable drain, wherein such skid pad can be provided on baggage of a variety of different configurations.

Generally, the present invention includes a wear-resistent member for a flexible bag, the bag having a storage chamber and a base portion defining a drain opening. A screen member covers the drain opening, and the screen member defines a compartment in the chamber adjacent to the base portion of the bag. A skid pad is connected to the base portion adjacent the drain opening. The compartment is in fluid communication with the drain opening, and defines at least one discharge opening opposite the drain opening of the bag.

A valve member is slidingly carried in the compartment. The valve member is moveable between a first position for substantially blocking fluid communication between the discharge opening and the drain opening, and a second position for allowing fluid communication between the discharge opening and the drain opening, for thereby allowing fluid to drain from the enclosure. Also provided is a filter associated with the skid pad opening for preventing entry of foreign debris into the enclosure through the drain opening when the valve member is in the first position. present invention also includes a method of constructing a skid pad drain constructed in accordance with the present invention.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
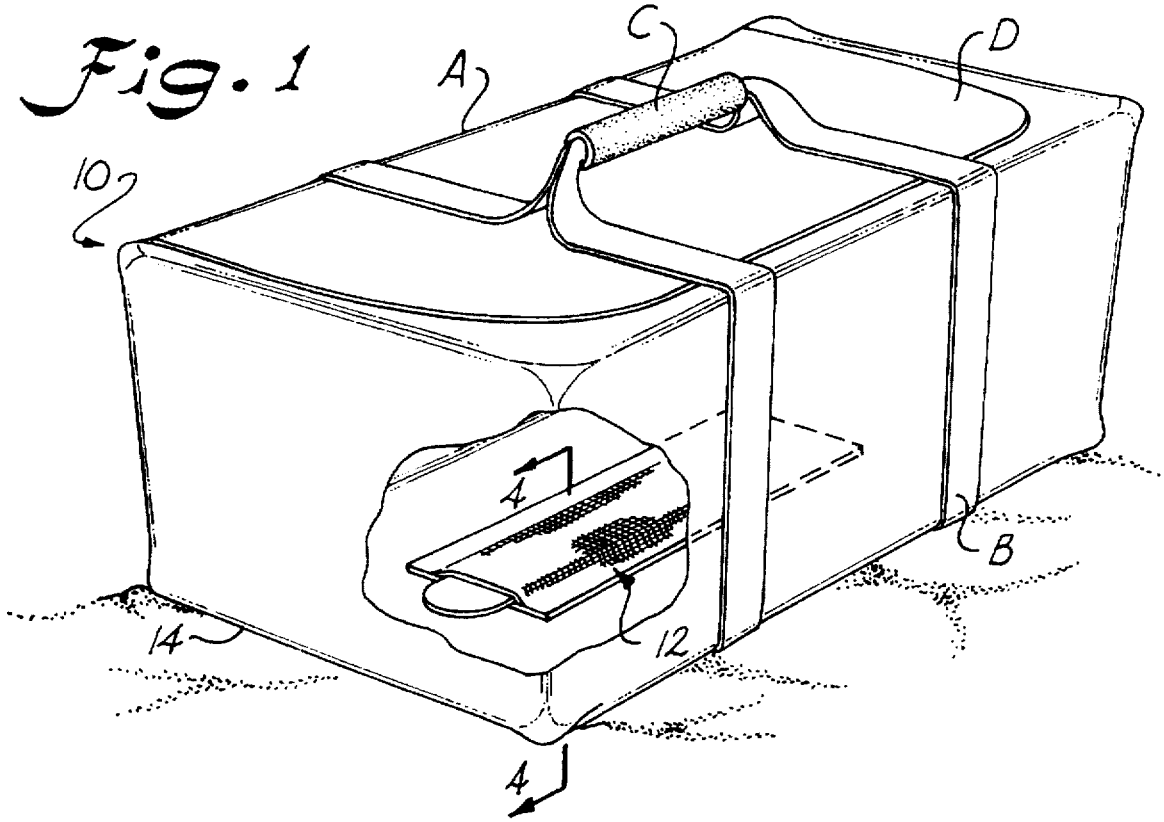
FIG. 1 is a perspective view, with parts cut away, of a baggage skid pad having an actuatable drain constructed in accordance with the present invention.

The accompanying drawings and the description which follows set forth this invention in its preferred embodiment. However, it is contemplated that persons generally familiar with baggage and scuba gear will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the baggage skid pad drain of the present invention is indicated generally in the figures by reference character 10.

Figure 2:
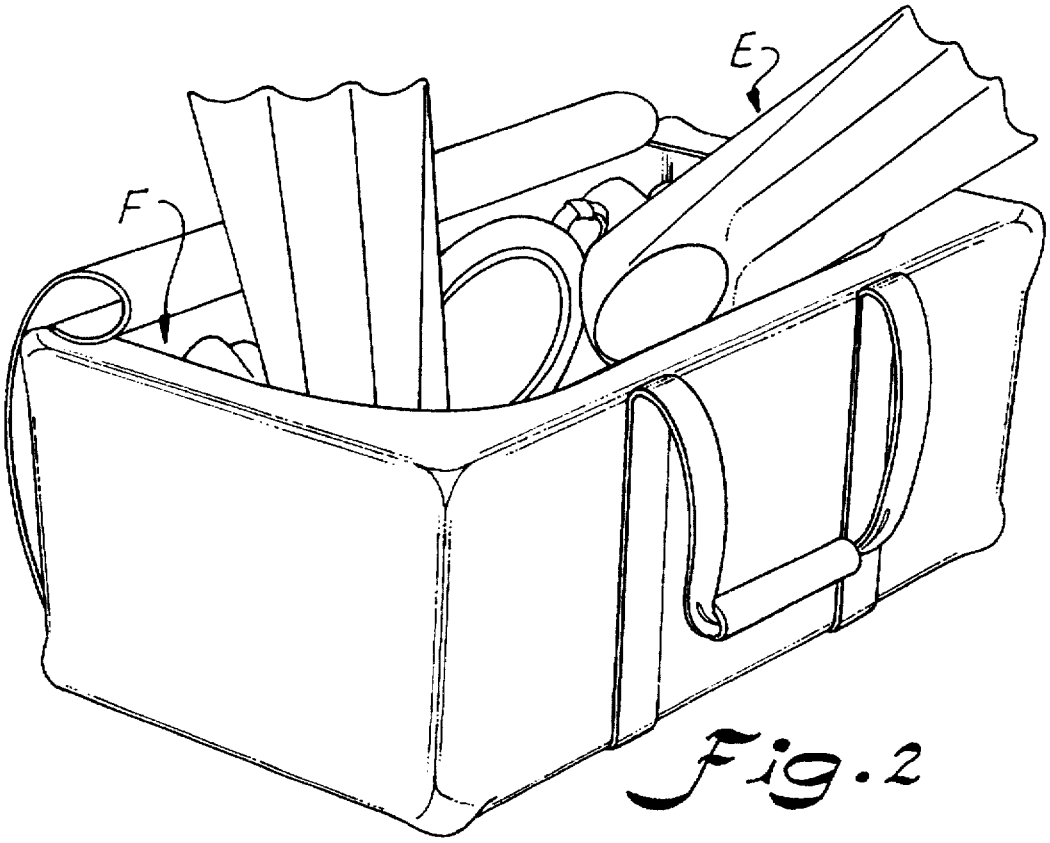
FIG. 2 is a perspective view of baggage having scuba gear therein.

Turning to FIG. 1, a piece of baggage, generally A is illustrated having an actuatable skid pad drain, generally 12, constructed in accordance with the present invention. Bag A is preferably constructed of flexible woven material, plastic, or the like. Bag A includes support straps, generally B, a handle, generally C, and a flap cover D, which could be securely connected to Bag A for closure by means of a conventional zipper, snap, Velcro fastening system, none of which is shown. As illustrated in FIG. 2, Bag A may be specifically designed for carrying water sports gear, such as scuba gear, generally E, or underwater salvage equipment, life vests, water ski equipment, etc., in a storage chamber F of Bag A.

Figure 5:
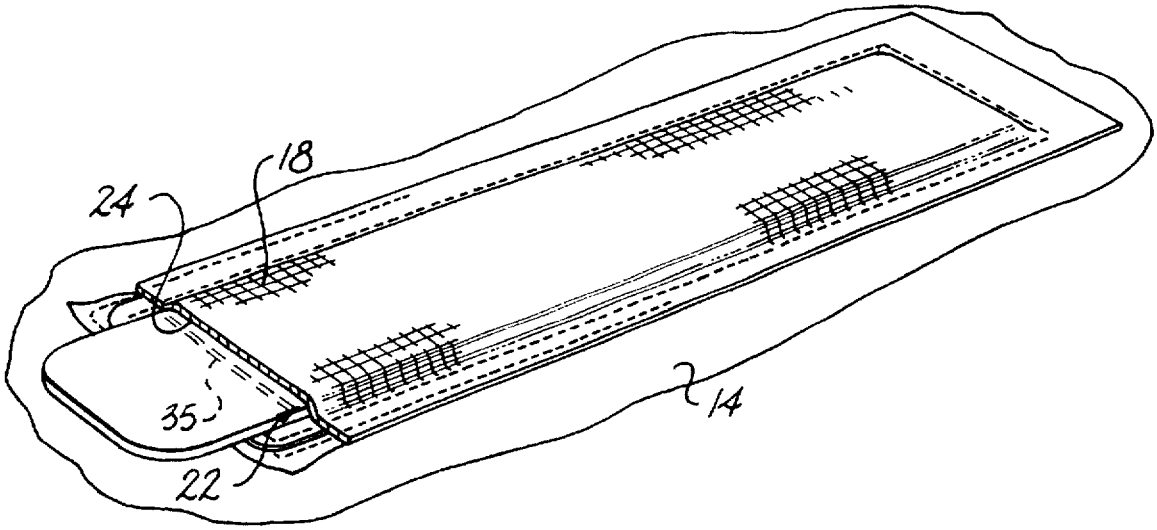
FIG. 5 is a perspective view of a skid pad having an 20 actuatable drain constructed in accordance with the present invention.
Figure 6:
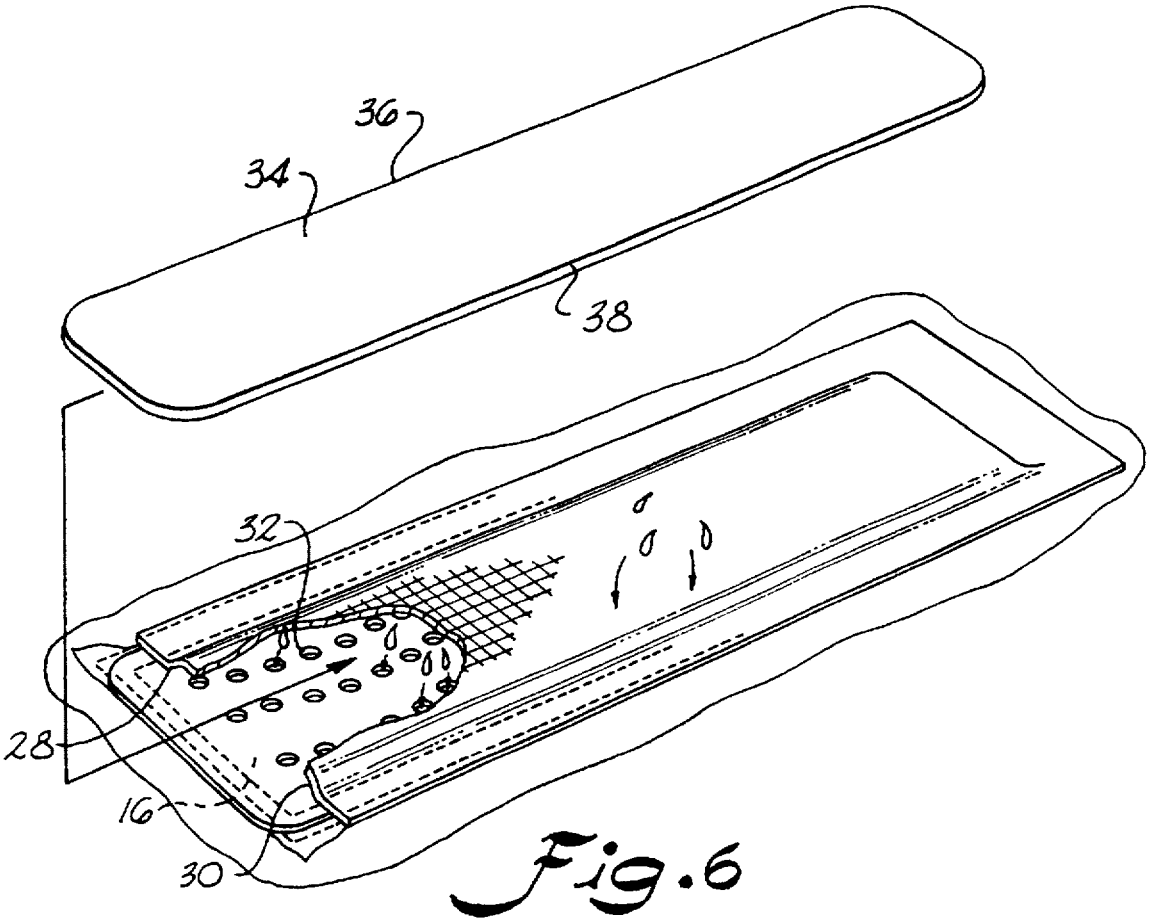
FIG. 6 is an exploded view of a skid pad with an actuatable drain constructed in accordance with the present invention.

Turning more specifically to the draining skid pad 12, and in particular FIGS. 5 and 6, pad 12 is affixed to a base portion, generally 14, of Bag A through stitching, adhesives, thermal or ultrasonic welding, or any other suitable fastening means. A drain opening 16 is provided in floor or base portion 14 of, the bag, and an elongated screen member 18 covers drain opening 16, screen member 18 being in the interior of the bag. Covering drain opening 16 on the exterior portion of the bag is a skid pad, generally 20, which is preferably positioned at a high wear point of the bag A. It is to be understood that the bag could include a plurality of skid pads (not shown), the skid pads being of the type disclosed herein, or of conventional design, in addition to the pad 12 assembly.

Screen member 18 defines an elongated compartment 22 between itself and the floor 14 of the bag. The compartment 22 created by screen mesh member 18 defines a first elongated side 24 and a second elongated side 26 opposite first side 24. Each side 24, 26 is formed in a manner to define a longitudinally extending track 28, 30, respectively, in compartment 22. Each track 28, 30 extends substantially the length of compartment 22.

Mesh member 18 acts as a discharge opening 32 for allowing fluid communication between the interior of bag A and compartment 22. In other words, water which drains from equipment carried in the bag will drain through mesh member 18 into compartment 22. However, an elongated valve member 34, which is slidingly carried in compartment 22 substantially diminishes, or may even prevent water from exiting bag A from compartment 22.

Valve member 34 includes a first elongated edge 36 and a second elongated edge 38 opposite first edge 36. Each of the edges 36, 38 are slidingly carried in tracks 28, 30, respectively, defined in compartment 22. Valve member 34 is preferably constructed of a flexible plastic material, although it could be constructed of metal, fabric, rubber, or any other suitable material, if desired.

Valve member 34 is moveable between a first position, wherein it is substantially entirely contained in compartment 22, to a second position, wherein it is removed entirely or partially from compartment 22. When valve member 34 is in the first position, water or other fluid is substantially prevented from exiting the bag. When valve member 34 is removed from the compartment, the maximum flow rate of fluid from the drain opening 16 would be achieved. Of course, valve member 34 can be removed partially outwardly from compartment 22 in order to meter or regulate fluid flow through drain opening 16. As shown in FIG. 5, a gasket 35 constructed of resilient gasket material, could be provided about the periphery of valve member 34 in order to more tightly seal valve member 34 in compartment 22. Alternatively, the resilient gasket material could be provided along sides 24, 26 of compartment 22 instead, if desired.

Figure 3:
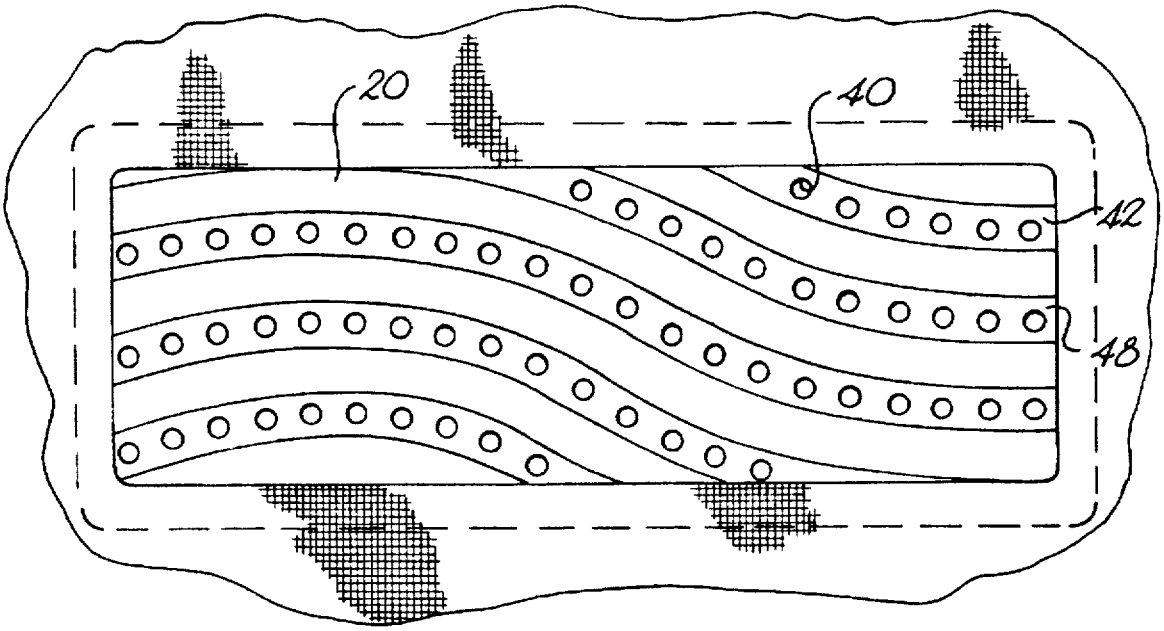
FIG. 3 is a bottom plan view of a skid pad drain constructed in accordance with the present invention.
Figure 4:
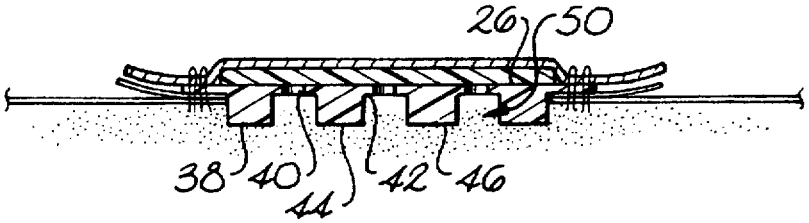
FIG. 4 is a sectional view taken along lines 4—4 of FIG. 1.

Turning now to FIGS. 3 and 4, pad 20 will be discussed in more detail. Pad 20 includes a plurality of perforations or holes 40, through which fluid will exit compartment 22, and accordingly, the interior of the bag, when valve member 34 is partially or completely removed from compartment 22. Holes 40 are preferably provided in valleys or channels 42, located alternatingly with ridges 44. Ridges 44 include support surfaces 46 of skid pad 20, which would actually contact the surface on which bag A rests. In other words, surfaces 46 would provide the primary wear resistant surfaces of pad 20. Because holes 40 are recessed in the channels 42, and because the ends 48 of such channels are open, channels 42 provide conduits 50 from which water may freely exit the bag even when the bag is resting on a surface. Placement of holes 40 in the base of channels 42 also further inhibits introduction of foreign matter or debris into compartment 22. Although ridges 44 and channels 42 are illustrated in FIG. 3 as being curvilinear in nature, it is understood they could run straight longitudinally, diagonally, or transversely, or any combination thereof, if desired.

In operation, when wet equipment E is placed in bag A, valve member 34 could be removed from compartment 22 to allow for drainage of water from the equipment prior to bag A being loaded in a vehicle. If bag A is to be loaded, for example, in the back of an uncovered cargo compartment of a pickup truck, the user may desire to simply leave valve member 34 out of compartment 22 in order to allow complete drainage of the equipment during transport. If, however, bag A is to be transported in the trunk of an automobile, the user may want to reinsert valve member 34 into compartment 22 prior to loading bag A into the trunk. Once the bag has reached its destination, it could be removed from the trunk, and valve member 34 could also be removed to allow final drainage.

From the foregoing, it can be seen that the present invention provides a dual purpose skid pad 12. Instead of requiring separate grommets, or other drain openings in a bag, in addition to separate skid pads for wear resistance, the drainable skid pad 12 accomplishes both of those purposes with one assembly. This eliminates the need for separate sewing or manufacturing operations, which may be required for providing drain openings and separate skid pads. Also importantly, the present invention provides not only a combination skid paddrain, it also provides a drain which is actuatable, and furthermore, provides filtering means through use of mesh member 18 and holes 40, for preventing sand, dirt, and foreign matter from entering a bag during drainage.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A wear-resistant structure for connection to a flexible bag having a storage chamber and a drain opening in a base portion of the storage chamber, the wear-resistent structure comprising:

a screen member carried in the storage chamber and covering the drain opening, said screen member defining a compartment adjacent the base portion of the storage chamber;

a pad connected to said base portion outside of the storage chamber, said pad having filter means for allowing water to pass through the drain opening and for preventing entry of sand and dirt into the drain opening, said filter means being in fluid communication with both said compartment and the environment;

said compartment being in fluid communication with the drain opening, and said compartment defining a first side and a second side opposite said first side; and said compartment defining a discharge opening in the storage chamber opposite the drain opening; and a valve member slidingly carried in said compartment, said valve member being moveable between a first position for substantially blocking fluid communication between said discharge opening and the drain opening and a second position for allowing fluid communication between said discharge opening and the drain opening to thereby allow fluid to drain from the storage chamber to the environment.

2. A wear-resistant structure as defined in claim 1, wherein said first and second sides of said compartment each define a track in said compartment, and said valve member is slidingly carried in said tracks of said first and second sides of said compartment.

3. A wear-resistant structure as defined in claim 1, wherein said compartment and said valve member are both elongated.

4. A wear-resistant structure as defined in claim 1, wherein said filter means includes a plurality of pad openings defined in said pad.

5. A wear-resistant structure as defined in claim 1, wherein said pad defines at least one channel in fluid communication with said filter.

6. A wear-resistant sructure for connection to a flexible bag having a storage chamber and a drain opening in a base portion of the storage chamber, the wear-resistent structure comprising:

a screen member carried in the storage chamber and covering the drain opening, said screen member defining a compartment adjacent the base portion of the storage chamber;

a pad connected to said base portion outside of the storage chamber, said pad having a filter covering said drain opening for preventing entry of foreign debris into the storage chamber through the drain opening, said filter being in fluid communication with both said comparment and the environment;

said compartment being in fluid communication with the drain opening, and said compartment defining a first side and a second side opposite said first side; and said compartment defining a discharge opening in the storage chamber opposite the drain opening;

a valve member slidingly carried in said compartment, said valve member being moveable between a first position for substantially blocking fluid communication between said discharge opening and the drain opening and a second position for allowing fluid communication between said discharge opening and the drain opening to thereby allow fluid to drain from the storage chamber to the environment; and a resilient gasket member connected to said valve member for sealing said valve member in said compartment.

7. A flexible bag, comprising:

the bag defining a storage chamber having a base portion, said base portion defining a drain opening;

a screen member carried in said storage chamber and covering said drain opening, said screen member defining a compartment adjacent said base portion of the storage chamber;

a wear-resistant pad connected to said base portion outside of said storage chamber, said pad having a bearing surface for supporting the flexible bag and filter openings recessed inwardly from said bearing surface covering said drain opening for preventing entry of foreign debris into said storage chamber through said drain opening, said filter being in fluid communication with both said compartment and the environment;

said compartment being in fluid communication with said drain opening, and said compartment defining a first side and a second side opposite said first side; and said compartment defining a discharge opening in the storage chamber opposite the drain opening; and a valve member slidingly carried in said compartment, said valve member being moveable between a first position for substantially blocking fluid communication between said discharge opening and said drain opening and a second position for allowing fluid communication between said discharge opening and said drain opening to thereby allow fluid to drain from said storage chamber to the environment.

8. A flexible bag as defined in claim 7, wherein said wear-resistant pad defines at least one channel in fluid communication with said filter.

9. A flexible bag, comprising:

the bag defining a storage chamber having a base portion, said base portion defining a drain opening;

a screen member carried in said storage chamber and covering said drain opening, said screen member defining a comparment adjacent said base portion of the strage chamber;

a wear-resistant pad connected to said base portion outside of said storage chamber, said pad having a filter covering said drain opening for preventing entry of foreign debris into said storage chamber through said drain opening, said filter being in fluid communication with both said compartment and the environment;

said compartment being in fluid communication with said drain opening, and said comparment defining a first side and a second side opposite said first side; and said compartment defining a discharge opening in the storage chamber opposite the drain opening;

a valve member slidingly carried in said compartment, said valve member being moveable between a first position for substantially blocking fluid communication between said discharge opening and said drain opening and a second position for allowing fluid communication between said discharge opening and said drain opening to thereby allow fluid to drain from said storage chamber to the environment; and a resilient gasket member connected to said valve member for sealing said valve member in said compartment.

* * * * *